US009166326B1

(12) United States Patent
Billman et al.

(10) Patent No.: US 9,166,326 B1
(45) Date of Patent: Oct. 20, 2015

(54) ELECTRICAL CONNECTOR WITH CONTACT GUARD

(71) Applicant: Phoenix Contact Development and Manufacturing, Inc., Middletown, PA (US)

(72) Inventors: Timothy Brian Billman, Dover, PA (US); Scott Anthony Faulkner, Harrisburg, PA (US); Tod M. Harlan, Mechanicsburg, PA (US); Kevin Walker, Hershey, PA (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 14/243,196

(22) Filed: Apr. 2, 2014

Related U.S. Application Data

(60) Provisional application No. 61/901,538, filed on Nov. 8, 2013.

(51) Int. Cl.
*H01R 13/44* (2006.01)

(52) U.S. Cl.
CPC ..... *H01R 13/44* (2013.01)

(58) Field of Classification Search
CPC ..... H01R 13/44; H01R 13/447; H01R 13/443
USPC ..... 439/135, 134, 133
See application file for complete search history.

(56) References Cited

U.S. PATENT DOCUMENTS

| | | | | |
|---|---|---|---|---|
| 3,474,386 | A | 10/1969 | Link | |
| 5,244,420 | A | 9/1993 | Lopata | |
| 5,360,349 | A | 11/1994 | Provencher et al. | |
| 6,113,436 | A | 9/2000 | Kuwahara et al. | |
| 6,619,987 | B2 | 9/2003 | Kumamoto et al. | |
| 7,682,172 | B2 | 3/2010 | Lu | |
| 7,878,827 | B2 | 2/2011 | Yao et al. | |
| 7,955,097 | B2 | 6/2011 | O'Leary et al. | |
| 8,398,442 | B2 | 3/2013 | Yagi et al. | |
| 2014/0162485 | A1 * | 6/2014 | Billman et al. | 439/350 |

OTHER PUBLICATIONS

Billman et al., US Patent Application for "Modular Electric Power Distribution System," U.S. Appl. No. 13/836,074, filed Mar. 15, 2013.

* cited by examiner

*Primary Examiner* — Javaid Nasri
(74) *Attorney, Agent, or Firm* — Boyle Fredrickson, S.C.

(57) ABSTRACT

An electrical connector has a plastic body and a blade contact in a terminal cavity in the body. A guard extends across the mouth of the cavity over an adjacent edge of the blade. A physical interlock connection holds the guard on the blade edge to shield the blade and prevent an object inserted into the mouth from contacting the blade.

19 Claims, 5 Drawing Sheets

ELECTRICAL CONNECTOR WITH CONTACT GUARD

BACKGROUND OF THE DISCLOSURE

Electrical connectors with plate contacts form electrical connections with terminals which are inserted into cavities in the connectors and engage both sides of the plate contacts in the cavities. These types of terminals may be used in power distribution systems which handle high-voltage and high-amperage current. The outer edges of the plate contacts in the cavities are exposed at the cavity mouths before terminals are inserted.

It is desirable to prevent inadvertent contact with plate contacts in the connectors and avoid shocks and short circuits. Touch-safe standards require that electrical connectors prevent an object inserted into a cavity from engaging a plate contact.

A conventional connector has a plastic housing with a plastic rib overlying an end of a plate contact. The rib is not connected to the plate contact and can be displaced to permit contact with the plate contact. Deflectable plastic ribs do not meet touch-safe standards.

SUMMARY OF THE DISCLOSURE

The disclosed electrical connector includes an insulating body, a plate in a cavity in the body where the body includes a guard overlying the end of the plate with a physical interlock connection between the guard and the end of the plate securing the guard on the plate against lateral deflection by a probe or object inserted into the cavity mouth. The interlock connection between the guard and the plate may include formed surfaces on the end of the plate and on the inwardly facing surface of the guard which secure the guard on the plate against lateral deflection.

DESCRIPTION OF THE EMBODIMENTS

Figure 1:
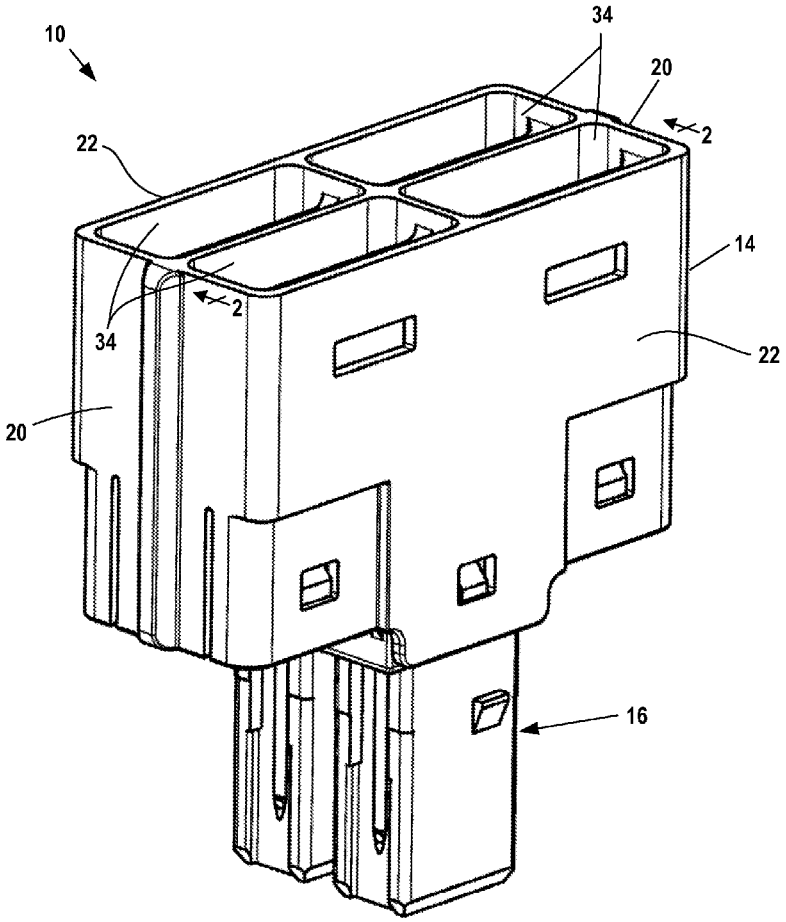
FIG. 1 is a perspective view of an electrical connector assembly.

Electrical connector assembly 10 includes two-part insulating body 12 with upper molded plastic body portion 14 and lower molded plastic body portion 16, and a pair of metal contacts 18. See FIG. 7.

The upper molded plastic body portion 14 has opposed, parallel end walls 20 and opposed, parallel side walls 22. Center wall 24 extends across the center of the body between the end walls 20. Transverse wall 26 extends across the body between the side walls 22 and intersects center wall 24. Horizontal wall 28 extends between the end and side walls 22 and 24 and joins the center and transverse walls 24 and 26 to form four rectangular terminal cavities 30. Cavities 30 open on the exterior surface 32 of body portion 14 at mouths 34 at the top of the body. An integral plastic terminal guard or rib 36 extends across the center of the mouth of each terminal cavity 30. A lower extension 38 of transverse wall 26 below wall 28 extends between end walls 20 to form two side-by-side cavities 40 at the bottom of body 14.

Figure 7:
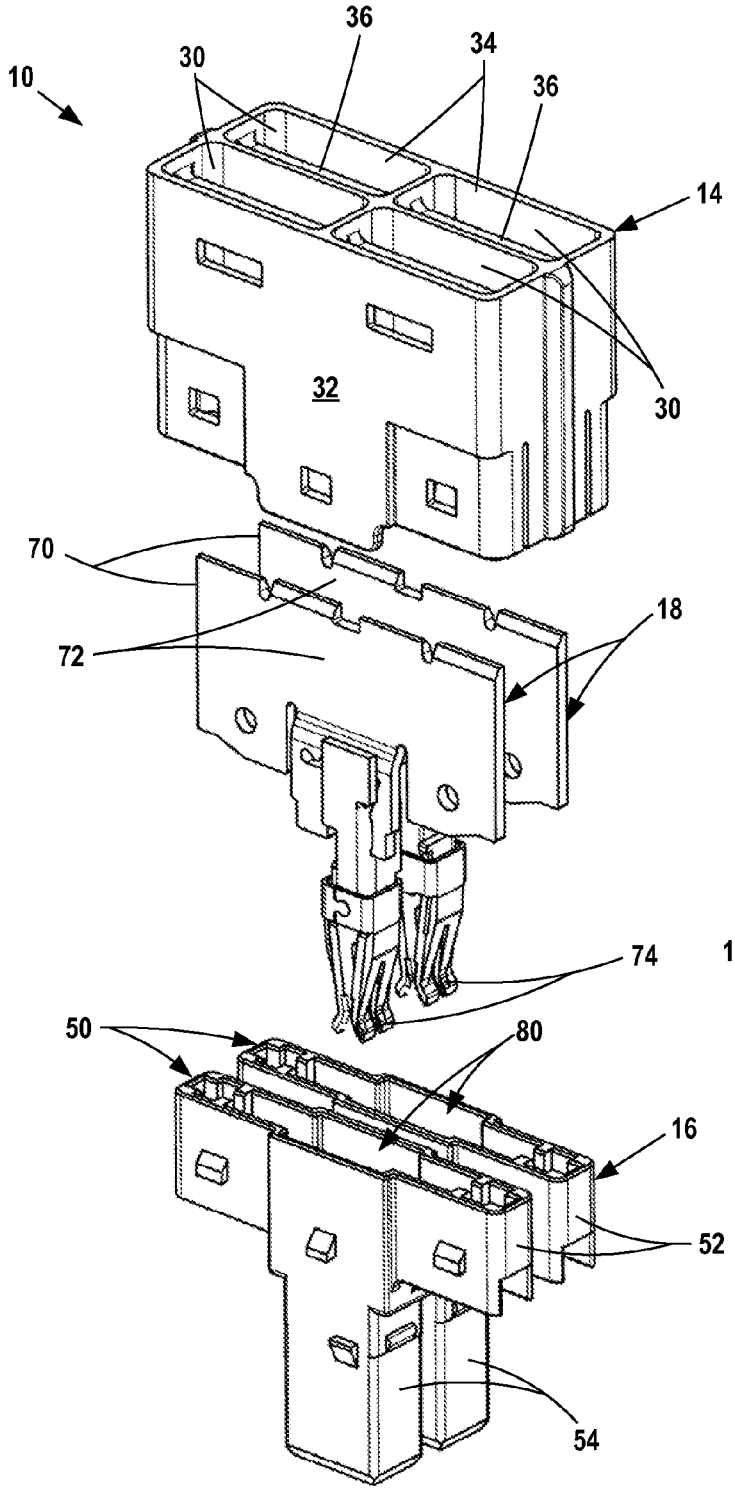
FIG. 7 is an exploded perspective view of the electrical connector assembly.

Lower molded plastic body 16 includes two T-shaped contact receiving shells 50, shown in FIG. 7. Each shell includes a wide blade-receiving upper portion 52 and a central, downwardly extending contact barrel 54. A contact opening 56 extends through the bottom of each barrel 54. The shells 50 are joined together by bridge 58.

Each metal contact 18 includes a flat metal contact plate having opposed contact sides 72. A socket terminal 74 is mounted on and extends downwardly from the bottom of each plate 70.

Assembly 10 is formed by inserting the two metal contacts 18 into terminal portions 52 and barrels 54 in body 16 so that the socket terminals 74 are fitted in barrels 54, and the lower portions of plates 70 are fitted in recesses 80 at the top of body 16. The upper portions of plates 70 extend above body 16.

Figure 2:
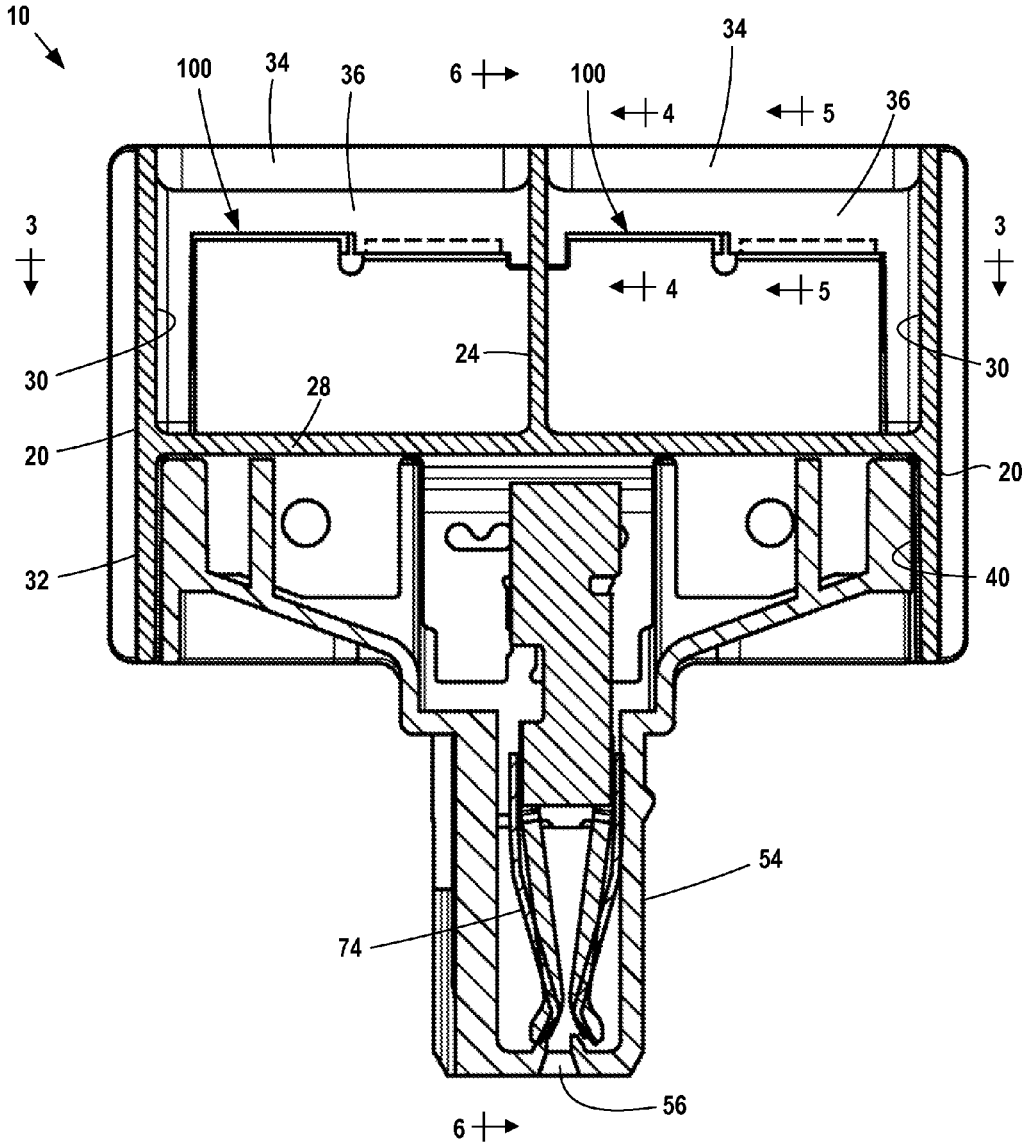
FIG. 2 is a vertical sectional view taken along line 2-2 of FIG. 1.
Figure 3:
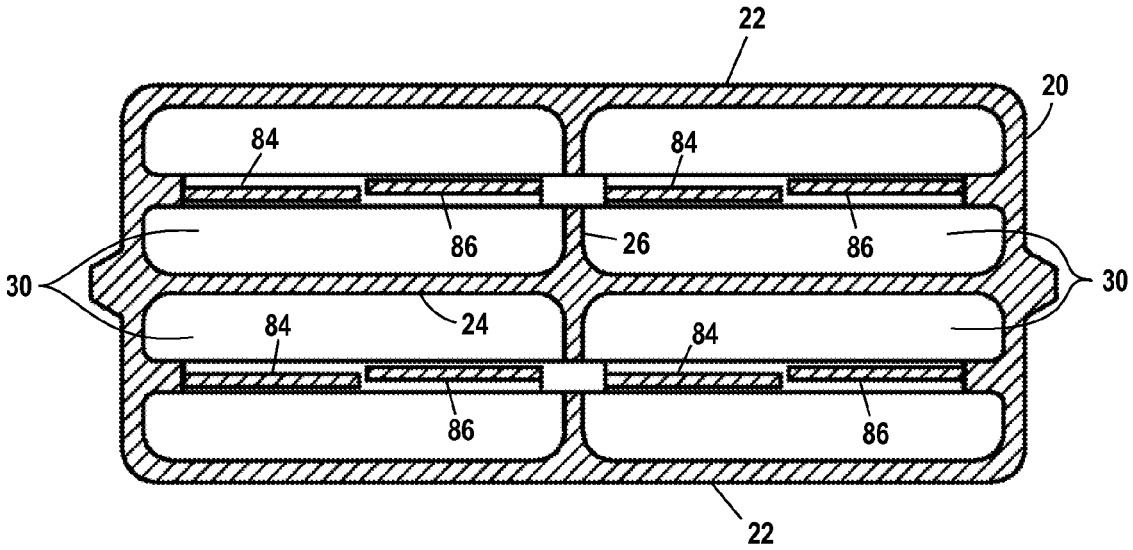
FIG. 3 is a horizontal sectional view taken along line 3-3 of FIG. 2.
Figure 4:
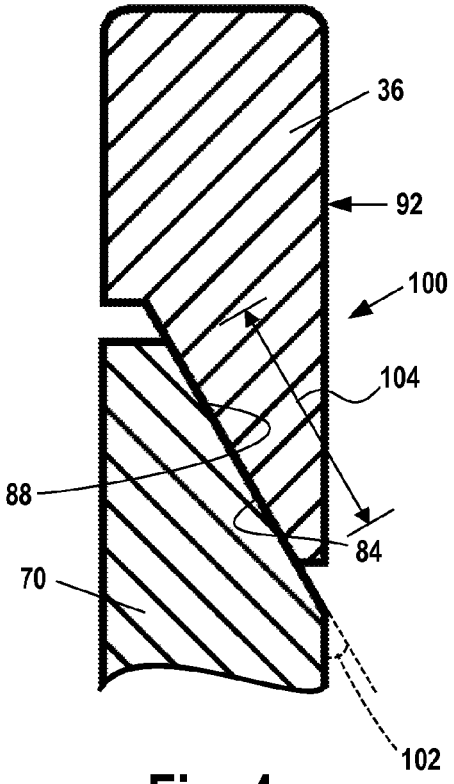
FIGS. 4 and 5 are vertical sectional views taken along lines 4-4 and 5-5 respectively of FIG. 2.

Upper body 14 is lowered onto lower body 16 and contacts 18. The upper portion of each plate 70 extends through a slot in wall 28 and into two cavities 30 spaced on one side of body 14. Slots 82 extend between end walls 20 in the centers of cavities 30. The upper portions of plates 70 extend upwardly into and across the centers of the terminal cavities 30 as shown in FIGS. 2 and 3.

Each guard 36 extends across the open end of a cavity 30 at cavity mouth 34 and includes two angled interlock surfaces 84 and 86 spaced along the guard edge and facing into the cavity, away from mouth 34. Angled interlock surfaces 84 face toward one side of each cavity, and angled interlock surfaces 86 face toward the opposite side of the cavity. Each surface 84, 86 extends approximately half way across cavity 30.

The top edge of each contact plate 70 includes a pair of angled interlock surfaces 88 and 90 in each cavity 30. Surfaces 88 and 90 each extend approximately half way across each cavity 30. When the metal contacts 18 are inserted in body 16 and body 14 is mounted on the top of the sub-assembly, the angled interlock surfaces 88 and 90 engage angled interlock surfaces 84 and 86 on the inner edge of the guards 36 in each cavity 30, as illustrated in FIGS. 2, 4, 5 and 6. The angled engagement between the interlock surfaces on the contact plate and on the interlock surfaces the guards forms physical interlock connections 100 which hold the thin, flexible plastic guards in place on the plates and prevent lateral displacement of the guards to expose the plates upon inadvertent contact with a member inserted into a mouth 34.

Angled interlock surface 84 on guard 36 engages interlock surface 88 on plate 70 to prevent displacement of the guard 36 from the plate by a force 92 applied to the side of the guard away from interlock surface 84. See FIG. 4. Likewise, the engagement between interlock surfaces 86 and 90 prevents displacement of the guard 36 from the top of plate 70 by a force 94 applied to the opposite side of the guard. The connections between the angled surfaces on the guard and top of the plate hold the guard in place and prevent displacement and downward bending of the plate into cavity 30.

Figure 6:
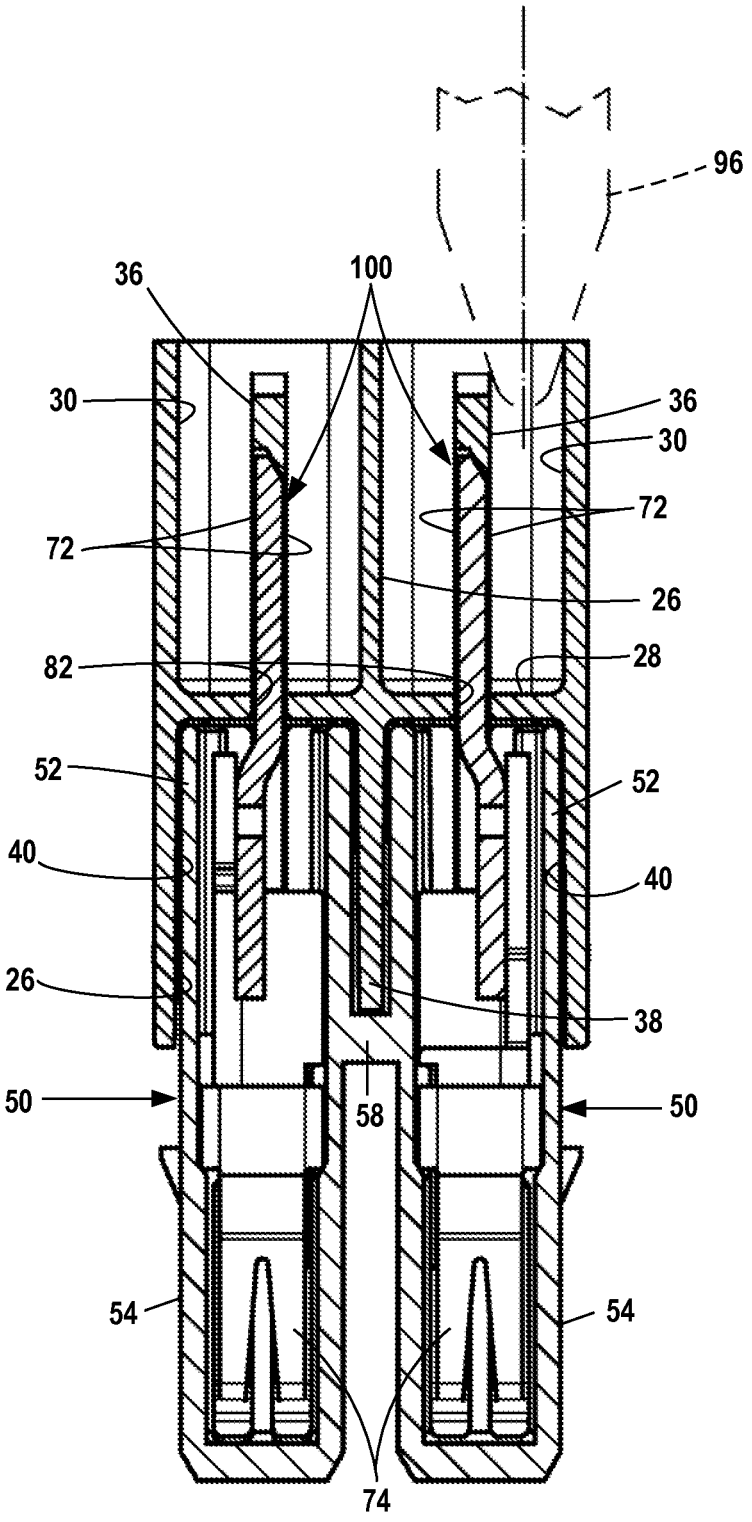
FIG. 6 is a vertical sectional view taken along line 6-6 of FIG. 2.

FIG. 6 illustrates a probe 96 inserted into mouth 34 of a terminal cavity 30. Engagement with the outer wall of the cavity forces the probe toward guard 36. The probe may be inserted on either side of the guard 36. The engagement between the guard and plate at surfaces 84 and 88 and 86 and 90 forms a physical interlock connection 100 securing the guard on the top of the plate and preventing the probe from displacing the guard from the plate. In this way, the guard prevents the probe from touching the plate.

Probe 96 engages guards 36 and exerts a force 92 on the guard tending to the move the guard away from plate 70. See FIG. 4. The force may be exerted on the guard at any location along the length of the guard in cavity mouth 34. The interlock connection 100 between surfaces 84 and 88 prevents lateral displacement of the guard from the plate to prevent the probe from contacting the plate.

Figure 5:
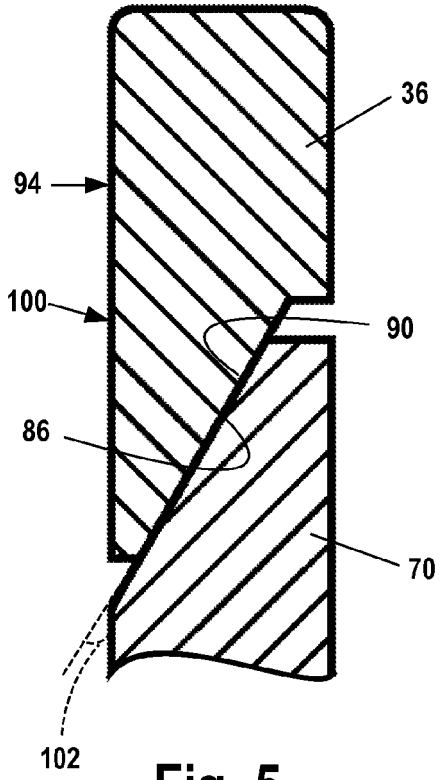

A probe may also be inserted into the mouth of the cavity to engage the opposite side of a guard 36 and exert a force 94 on the guard in the opposite direction, as shown in FIG. 5. The interlock connection 100 between surfaces 86 and 90 prevents movement of the guard from the top of plate 70. See FIG. 5.

Electrical connector assembly 10 may be used for forming electrical connections in a powerbus. A plurality of assemblies 10 may be spaced along the bus with pairs of conductor members joining adjacent assemblies. Each conductor member includes an elongate power conductor and terminals on the ends of the conductor. The terminals of two conductor members are inserted in cavities 30 on one side of assembly 10 and make electrical connections with the flat contact surfaces 72 on opposite sides of each contact plate 70. The plates 70 form portions of the elongate power conductors and connect the conductor members. Power from the conductor members is supplied to power consumers or suppliers through contacts inserted through openings 56 to engage socket terminals 74.

The terminals on the ends of the conductor member in the powerbus are inserted into cavities 30 past guards 36 and engage both contact surfaces 72 of plates 70. In order to protect the plates from inadvertent contact, the guards 36 have a minimum thickness substantially the same as the thickness of the plates 70. The guards are made of plastic and are somewhat flexible and, accordingly, may have a thickness somewhat greater than the thickness of the plate 70 to overlie the sides of the plates and provide additional protection against inadvertent contact. Insertion of the connectors on a powerbus over the guards deforms but does not permanently damage the guards.

Plates 70 may have a thickness of 1.00 mm. The guards may have a thickness or width of 1.00 mm or a greater thickness of 1.20 mm.

Engagement between the guards and plates at surfaces 84 and 88 and 86 and 90 form physical interlock connections 100 holding the guards on the upper ends of the plates against lateral deflection.

The angled interlock surfaces on the tops of plates 70 and on the inner edges of guards 36 extend at an angle 102 of 30° to the sides of the plate. The shallow 30° 102 provides an overlap distance 104 between the guard and plate greater than the thickness of the plate. The long overlap distance helps secure the guard on the plate when a deflecting force is applied to the guard.

In electrical connector assembly 10, the guards 36 are held on the tops of plates 70 by two spaced and angled connections at the surfaces 84 and 88 and 86 and 90 to form a physical interlock connection.

Figure 8:
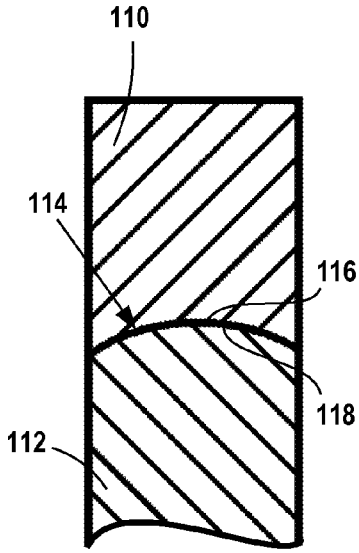
FIG. 8 is a sectional view similar to FIG. 4 or 5 showing an interlock connection.

Other types of physical interlock connections may be used to secure the guards on the upper ends of the plates. FIG. 8 illustrates a rib or guard 110, similar to guard 36 mounted on the upper edge of a contact plate 112, like plate 70, by a physical interlock connection 114. The upper edge of plate 112 is rounded to a convex shape 116. The lower edge of the rib 110 has a concave shape 118 and is fitted over a convex edge of the plate to form the interlock connection 114. Edges 116 and 118 extend along the full length of the plate and guard so that the full length of the guard is secured to the plate against lateral deflection to either side of the plate. If desired, the convex surface may be on the guard, and the concave surface may be on the plate.

The physical connection 114 uses inter-engaging curved convex and concave surfaces 116 and 118. These surfaces need not be curved. For instance, the convex surface may be two surfaces which may intersect each other, and the concave surface may be two surfaces complimentary to the convex surface which may intersect each other and which engage the concave surfaces.

What we claim as our invention is:

1. An electrical connector comprising an insulating body, a cavity in the insulating body, a mouth on the body opening into the cavity, and an insulating guard extending across the mouth; and a metal contact in the cavity, the metal contact including opposed contact surfaces facing to either side of the insulating guard and an edge under the guard, the guard including a guard interlock surface and the contact including a contact interlock surface, the guard interlock surface and the contact interlock surface engaging each other to form a physical interlock connection securing the guard to the metal contact, wherein the interlock connection holds the guard on the contact to prevent a member inserted into the mouth from touching the edge of the metal contact.

2. The electrical connector as in claim 1 wherein the guard interlock surface faces into the cavity, and the contact interlock surface faces out from the cavity.

3. The electrical connector as in claim 2 wherein the guard has a width and the edge has a transverse dimension; and the width of the guard is substantially equal to or greater than the transverse dimension of the edge.

4. The electrical connector as in claim 3 wherein the contact comprises a plate.

5. The electrical connector as in claim 4 wherein the guard overlies the plate.

6. The electrical connector as in claim 5 wherein the contact includes a terminal away from the edge.

7. The electrical connector as in claim 5 wherein the connection includes a concave portion and a convex portion, said concave and convex portions engaging each other.

8. The electrical connector as in claim 5 wherein the connection includes first and second guard surface portions facing in different directions and first and second contact surface portions facing in different directions, such guard interlock and contact interlock surface portions spaced along the guard and contact and engaging each other to secure the guard to the contact.

9. The electrical connector as in claim 8 wherein the guard interlock portions and the plate interlock portions are flat.

10. The electrical connector as in claim 5 wherein the guard interlock surface includes a plurality of interlock segments spaced along the guard and facing in different directions and the contact interlock surface includes a plurality of contact segments spaced along the contact, each guard segment engaging a contact segment.

11. The electrical connector as in claim 10 wherein the guard and contact segments are flat and overly each other.

12. The electrical connector as in claim 11 wherein the guard segments extend essentially across the width of the guard, and the contact segments extend essentially across the thickness of the plate.

13. The electrical connector as in claim 1 wherein the interlock connection includes a surface-to-surface overlap distance greater than the thickness of the contact.

14. The electrical connector as in claim 13 wherein the contact is a plate.

15. An electrical connector comprising an insulating body, a terminal cavity in the insulating body, a mouth on the body opening into the cavity, and an insulating guard extending across the mouth; and a metal contact plate in the terminal cavity, the plate including opposed contact surfaces facing to either side of the insulating guard and an edge under the guard, and an interlock connection securing the guard to the edge of the plate, wherein the connection holds the guard on the plate to prevent a member outside the connector from touching the edge.

16. The electrical connector as in claim 15 wherein the interlock connection includes a guard interlock surface facing toward the cavity, and a plate interlock surface facing out from the cavity, said surfaces engaging each other.

17. The electrical connector as in claim 16 wherein the contact has a transverse dimension at the edge; and the width of the guard is substantially equal to the transverse dimension of the contact.

18. The electrical connector as in claim 17 including a plurality of plate interlock surfaces spaced along the edge of the plate and a plurality of guard interlock surfaces spaced along the guard, such surfaces engaging each other.

19. The electrical connector as in claim 15 wherein the plate has a thickness; and the interlock connection includes an overlap distance greater than the thickness of the plate.

* * * * *